US011439196B2

(12) United States Patent
Chehebar

(10) Patent No.: US 11,439,196 B2
(45) Date of Patent: Sep. 13, 2022

(54) FLIP-FLOP CAPABLE OF CHANGING TO A SANDAL HAVING AN EMBEDDED REAR STRAP MOVABLE BETWEEN TWO POSITIONS

(71) Applicant: Joseph Chehebar, New York, NY (US)

(72) Inventor: Joseph Chehebar, New York, NY (US)

( * ) Notice: Subject to any disclaimer, the term of this patent is extended or adjusted under 35 U.S.C. 154(b) by 0 days.

(21) Appl. No.: 17/016,553

(22) Filed: Sep. 10, 2020

(65) Prior Publication Data

US 2022/0071337 A1 Mar. 10, 2022

(51) Int. Cl.
*A43B 3/24* (2006.01)
*A43B 3/12* (2006.01)

(52) U.S. Cl.
CPC ..... *A43B 3/126* (2013.01); *A43B 3/24* (2013.01)

(58) Field of Classification Search
CPC .. A43B 3/26; A43B 3/12; A43B 3/122; A43B 3/24
USPC ..... 36/11.5, 100
See application file for complete search history.

(56) References Cited

U.S. PATENT DOCUMENTS

| | | | | |
|---|---|---|---|---|
| 3,978,596 | A | 9/1976 | Brown et al. | |
| 7,331,122 | B2 | 2/2008 | Januszewski et al. | |
| 7,823,299 | B1 | 11/2010 | Brigham | |
| 10,441,021 | B1 * | 10/2019 | Polk | A43B 3/128 |
| 2006/0075656 | A1 * | 4/2006 | Januszewski | A43B 3/122 36/11.5 |
| 2007/0175065 | A1 * | 8/2007 | McDonald | A43B 3/24 36/11.5 |
| 2008/0168682 | A1 | 7/2008 | Le | |
| 2012/0152267 | A1 * | 6/2012 | Chang | A43B 3/106 132/200 |
| 2015/0033584 | A1 * | 2/2015 | Ferguson | A43B 3/244 36/103 |
| 2017/0181493 | A1 | 6/2017 | Graffeo | |
| 2019/0021445 | A1 * | 1/2019 | Eugene | A43C 11/24 |
| 2020/0008515 | A1 * | 1/2020 | Pellegrino | A43B 23/24 |
| 2020/0329808 | A1 * | 10/2020 | Bialuk | A43B 3/103 |

OTHER PUBLICATIONS

EP Communication with attached extended European Search Report issued for EP Application No. 21 02 0189, dated Sep. 28, 2021.

* cited by examiner

*Primary Examiner* — Marie D Bays
(74) *Attorney, Agent, or Firm* — ArentFox Schiff LLP

(57) ABSTRACT

The present invention provides footwear capable of changing between a flip-flop and a sandal. The structure of a flip-flop which includes a sole having a top section, a bottom section, a forefoot section, a heel section, and a sidewall section. Also, a forefoot cover having V-shaped straps is positioned and extends over at least a part of the forefoot section and is attached to the top section of the sole. A horizontal recess is formed in the heel section of the sole for receiving therein a horizontal strap, which is removably placed in the horizontal recess. The horizontal strap is moveable by the user between a first stored position in the recess, and a second in-use raised position, wherein the horizontal strap extends above the horizontal recess and covers the bridge of the user's foot in order to convert the flip-flop to a sandal for securing the foot more securely.

19 Claims, 8 Drawing Sheets

FLIP-FLOP CAPABLE OF CHANGING TO A SANDAL HAVING AN EMBEDDED REAR STRAP MOVABLE BETWEEN TWO POSITIONS

FIELD OF THE INVENTION

The present invention relates to footwear capable of changing between a flip-flop and a sandal. A flip-flop is provided with a movable horizontal strap embedded within a horizontal recess in the heel section of the sole that is movable to an upper position so the flip-flop also functions as a sandal for covering the bridge and upper ankle of the user's foot.

BACKGROUND OF THE INVENTION

A "flip-flop" is a known and commonly used type of footwear especially in warm climates or seasons that has existed since ancient times. Currently, flip-flops are typically worn while engaging in casual bathing activities at a beach or at a swimming pool. Flip-flops have a simple structure and design which provide convenience and easy access for their wearers. More specifically, flip-flops usually include a flat sole loosely held on the wearer's foot by a Y-shaped or V-shaped strap known as a "toe thong" that passes between the first and second toes and around both sides of the foot.

However, because of this simple design, flip-flops fail to provide a secure support for the foot which can lead to injuries. More specifically, the insecure support provided by flip-flops can lead to injuries, including: (a) causing the wearer to inadvertently roll their feet which can cause sprains or bone fractures, (b) causing the wearer to get tendonitis in their ankles as a result of the wearer overusing the tendons in their feet to try and compensate for the lack of support provided by their flip-flops, (c) causing the wearer frictional issues, such as blisters, as a result of the thong straps rubbing against the wearer's feet during walking, or (d) causing the wearer to experience cuts, scrapes, bruises, or stubbed toes as a result of the open toe design of flip-flops.

To avoid these types of injuries, many medical professionals and podiatrists recommend that people wear sandals instead of flip-flops. Unlike flip-flops, sandals are more secure and provide greater support for the wearer since their construction typically includes an open type of footwear having a sole which is held to the wearer's foot by a strap going over the instep and covering the bridge and upper ankle portion of the wearer's foot. This sandal construction provides more secure support that prevents injuries to the wearer's feet that are typically associated with loose fitting flip-flops. However, the additional support provided by sandal straps typically detracts from the convenience and easy access of wearing sandals.

Accordingly, there is a need for an improved flip-flop that provides convenience and easy access for their wearer while also providing the additional support and safety for the wearer that is normally associated with sandals. The present invention accomplishes the improved support and safety by providing a flip-flop with an additional strap that is stored within the sole of the flip-flop that can optionally be movable to an upper position by the wearer to cover the bridge and upper ankle portion of the foot to provide greater foot support and security when needed.

DESCRIPTION OF THE PRIOR ART

Numerous prior art patents disclose sandals and flip-flops having additional and optional straps for providing added support to a wearer's feet. However, none of these prior art patents disclose a horizontal strap removably embedded in a recess of the base of the sole for converting a flip-flop into a more secure and safe sandal.

For instance, prior art U.S. Pat. No. 7,331,122 to John Januszewski, et al. which issued on Feb. 19, 2008 discloses footwear to be used as a convertible sandal having a sole, a forefoot cover, and a heel strap. The forefoot cover is securely attached to the sole and extends over the forefoot portion of the sole. Further, the sole includes a sidewall having an interlocking section along the heel portion of the sole. The heel strap is adapted to be set within the interlocking section of the sidewall of the sole to thereby hold the rear heel support to the sidewall of the sole. As such, a user has the option of using the heel strap to secure his heel to the heel portion of the sandal, or alternatively setting the heel strap within the interlocking section of the sidewall and thereafter using the sandal in a "flip-flop" style. More specifically, this prior art patent discloses a sandal having V shaped straps and a rear strap 116, 118 (shown in FIG. 1), which pivots from a lower position surrounding the base to a raised position covering the ankle.

Prior art U.S. Pat. No. 7,823,299 to John P. Brigham which issued on Nov. 2, 2010 discloses a flip-flop/sandal that is capable of conversion between a flip-flop and a sandal by movement of a heel and/or forefoot band between a first stored position and a second in-use position. The heel and/or forefoot band is capable of rotational movement between a first stored and a second in-use position by a central member rotatably secured and received by the sole. More specifically, this prior art patent discloses a sandal having V-shaped straps and a rear strap 18 (shown in FIG. 1), which pivots from a lower position surrounding the base to a raised position covering the ankle.

Prior art U.S. Published Patent Application No. 2008/0168682 to Tuan Le which published on Jul. 17, 2008 discloses a sandal having a multi-positional strap including a sole having a heel portion, a forefoot portion, a lateral side and a medial side. The sandal includes a first strap portion having a fixed position with respect to the sole, and a pair of convertible strap portions having moveable positions with respect to one another and to the sole. More specifically, this prior art patent application discloses a sandal having V shaped straps and a rear strap 58 (shown in FIG. 1C), which pivots from a first position to a second position covering the ankle.

Prior art U.S. Pat. No. 3,978,596 to Dwight C. Brown, et al. which issued on Sep. 7, 1976 discloses a foot sandal having a platform with an upper and a lower layer. Stirrup strapping members are mounted with the platform for securing the platform to the foot with the stirrup strapping members, including a loop extending through the upper layer of the laminated platform and a toe securing member. More specifically, this prior art patent discloses a front circular strap 30 and a rear pivoting strap 32 (shown in FIGS. 1 and 2), which pivots from a first position to a second position covering the ankle.

OBJECTS OF THE INVENTION

It is an object of the present invention to provide a new and improved flip-flop that can optionally and easily be converted into a sandal by the user moving a horizontal strap that is stored and embedded within a recess formed in the sole of the flip flop when it is not in use.

Another object of the present invention is to provide a flip-flop with a movable horizontal strap that provides greater support and security to the bridge and upper ankle portion of the user's foot.

Another object of the present invention is to provide a new and improved flip-flop that can be converted into a sandal which may be easily and efficiently manufactured and marketed.

Another object of the present invention to provide a new and improved flip-flop that can be converted into a sandal which has a durable and reliable construction.

Another object of the present invention is to provide a new and improved flip-flop that can be converted into a sandal for providing multiple footwear styles for a wearer.

A further object of the present invention is to provide a new and improved flip-flop that can be converted into a sandal that has a low cost of manufacture with regard to materials and labor, and has a low cost to the consumer.

SUMMARY OF THE INVENTION

The present invention provides footwear capable of changing between a flip-flop and a sandal. The structure of the flip-flop includes a sole having a top section, a bottom section, a forefoot section, a heel section, and a sidewall section. The forefoot section has V-shaped or Y-shaped straps which extend over at least a part of the forefoot section and are attached to the top section of the sole.

In addition, the present invention includes a horizontal strap embedded in a recess or pocket in the top of the sole for converting the flip-flop into a sandal. Specifically, a horizontal recess or pocket is formed in the heel section of the sole for receiving the horizontal strap. Also, the horizontal strap is capable of moving between a first stored flat position within the recess and a second in-use raised position, wherein the horizontal strap extends above the horizontal recess and is positioned to cover the bridge and upper ankle of the wearer's foot.

The horizontal strap preferably is a single strap made of an elastic material to aid in adjusting the horizontal strap around and over the bridge of the user's foot. Further, the horizontal strap includes two terminal ends. At least one of these terminal ends of the horizontal strap is attached within the horizontal recess formed in the heel section of the sole, or alternatively, the horizontal strap is attached to the sidewall section of the sole.

In an alternate embodiment, the horizontal strap includes two horizontal bands, a first horizontal band and a second horizontal band. The first and second horizontal bands each have first terminal ends attached to the sidewall of the sole and second terminal ends attached to mechanical fasteners. The respective mechanical fasteners of the first and second horizontal bands are mateably engageable so that the first horizontal band and the second horizontal band can be removably connected.

In a further alternate embodiment, the horizontal strap includes two horizontal bands, a first horizontal band and a second horizontal band. The first and second horizontal bands each have first terminal ends attached to within the horizontal recess of the sole and second terminal ends attached to mechanical fasteners. The respective mechanical fasteners of the first and second horizontal bands are mateably engageable so that the first horizontal band and the second horizontal band can be removably connected.

DETAILED DESCRIPTION OF THE PREFERRED EMBODIMENT

First Preferred Embodiment

Figure 1:
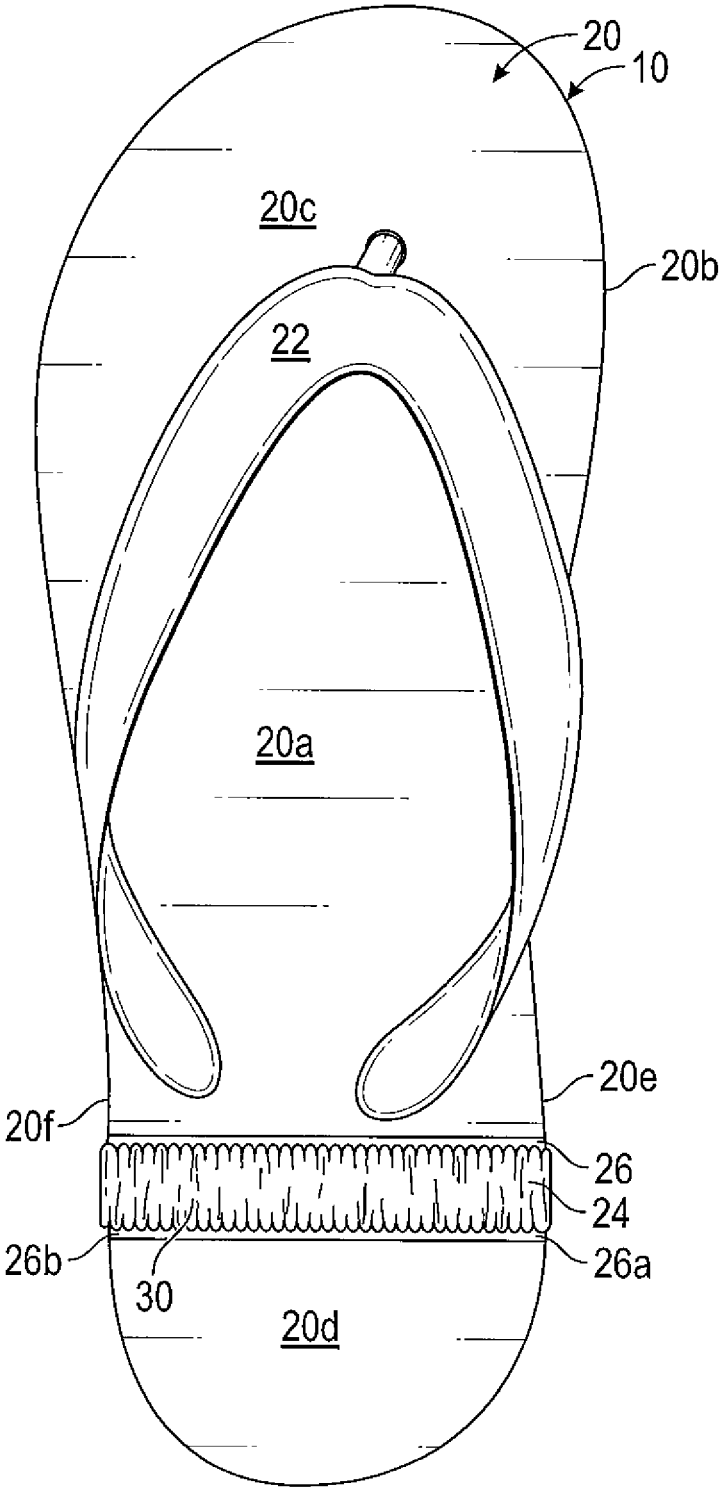
FIG. 1 is a top view of the footwear functioning as a flip-flop with the horizontal strap in its stored flat position embedded in a horizontal recess or pocket in the heel section of the upper sole.
Figure 2:
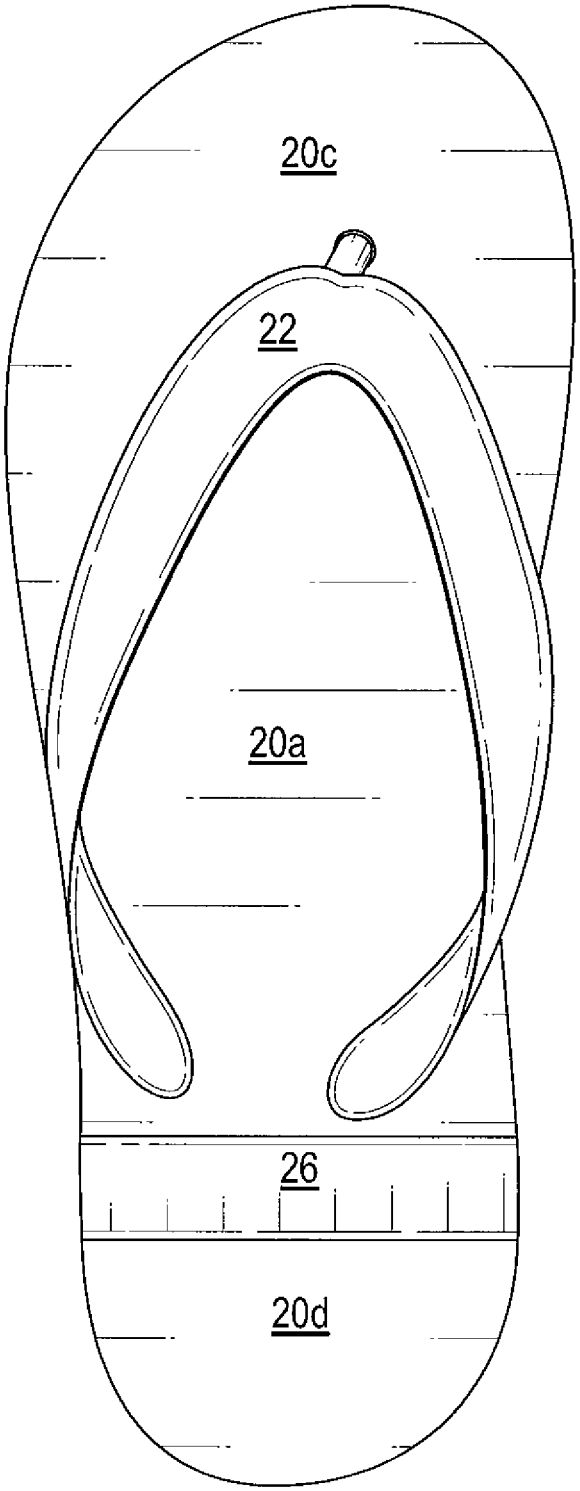
FIG. 2 is a top view of the upper sole of the footwear showing the horizontal recess or pocket for embedding the horizontal strap in the upper sole.
Figure 3:
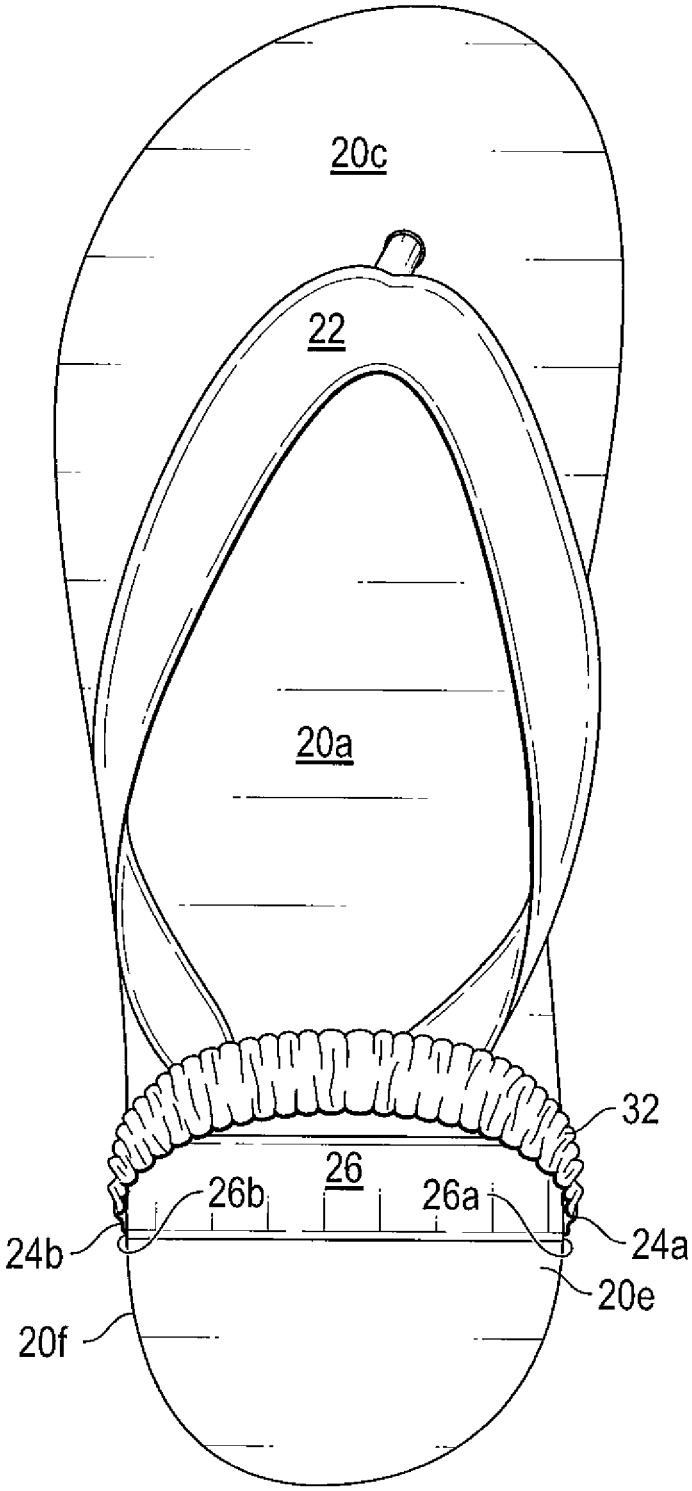
FIG. 3 is a top view of the sole of the footwear functioning as a sandal with the horizontal strap in its raised position for encircling and covering the bridge of the wearer's foot to provide additional support and security for the wearer's foot.
Figure 4:
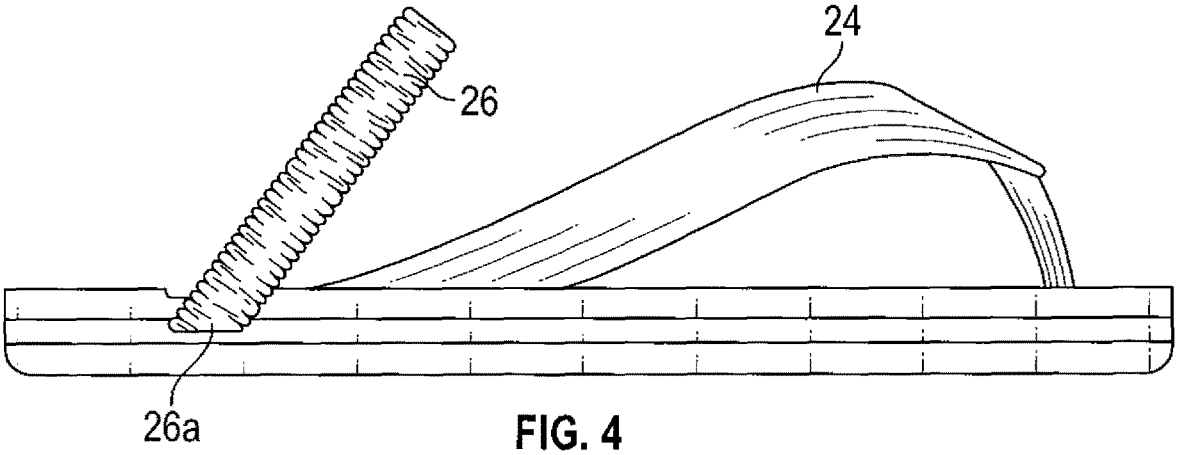
FIG. 4 is a side view of the footwear functioning as a sandal with the horizontal strap in its raised position for encircling and covering the bridge of the wearer's foot to provide additional support and security for the wearer's foot.
Figure 5:
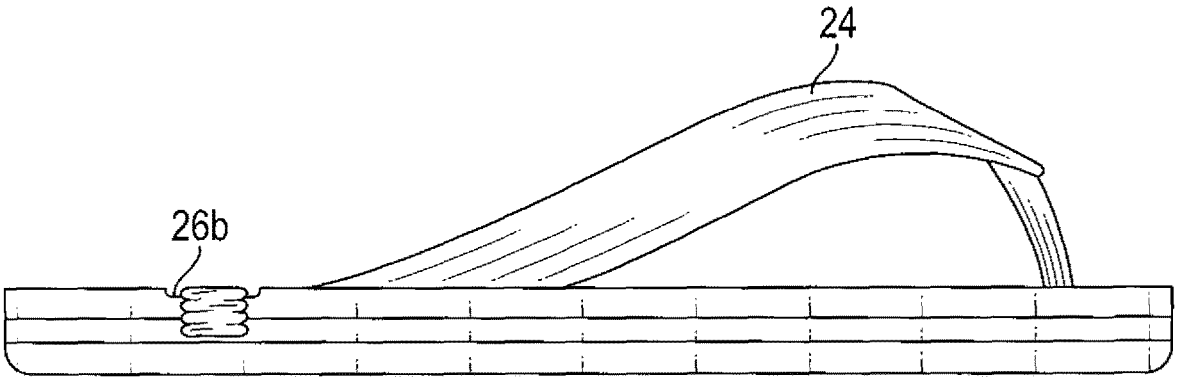
FIG. 5 is a side view of the footwear functioning as a flip-flop with the horizontal strap in its stored flat position embedded in the horizontal recess or pocket of the heel section of the sole.

The first preferred embodiment of the present invention as shown in FIGS. 1 to 5, provides footwear 10 capable of changing between a flip-flop and a sandal. The structure of the flip-flop includes a sole 20 having a top section 20*a*, a bottom section 20*b*, a forefoot section 20*c*, a heel section 20*d*, a right sidewall section 20*e*, and a left sidewall section 20*f*. The sole 20 may be formed of materials including: rubber, vulcanized rubber, leather, ethyl vinyl acetate (EVA), polyurethane, dual density SSR, or any other synthetic or natural materials known in the art for constructing footwear soles.

Also, a forefoot cover 22 having V-shaped or Y shaped straps that take the shape of a "toe thong" passes between the first and second toes and around both sides of the foot. However, the forefoot cover 22 may also have any other shape that is desired by the user. The forefoot cover 22 is positioned and extends over at least a part of the forefoot section 20*c* and is attached to the top section of the sole 20*a*. The forefoot cover 22 is preferably comprised of elastic material and may be formed from synthetic fabric, but may alternatively be formed of any material such as leather, nylon, or any other material known within the field. Further, the forefoot cover 22 may be attached to the sole 20 using rivets, screws, latch members, adhesives, glue, or any other means known within the art. Alternatively, instead of mechanically attaching the forefoot cover 22 to the sole 20, the forefoot cover 22 and sole 20 may be a molded as a single unit of footwear construction.

In addition, the footwear 10 includes a horizontal strap 24 embedded in a horizontal recess or pocket 26 for converting the flip-flop into a sandal. Specifically, a horizontal recess 26 is formed, having a right side 26*a* and a left side 26*b*, and is formed in the heel section of the sole 20*d* for receiving the horizontal strap 24. The horizontal strap 24 is removably embedded within the horizontal recess 26 of the top section of the sole 20*a*. Also, horizontal strap 24 is capable of moving between a first stored flat position 30 within the recess 26, wherein the horizontal strap 24 fits flush within the recess 26, and a second in-use raised position 32. In the second in-use raised position 32, the horizontal strap extends above the horizontal recess 26 to cover and support the bridge portion and top portion of the ankle of the wearer's foot. In this respect, the horizontal strap 24 permits the footwear 10 to function as a sandal and provides greater support for the wearer's foot, in addition to the support provided by the "toe thong" construction of the forefoot cover 22.

The horizontal strap 24 is preferably formed of synthetic elastic fabric to aid in adjusting the horizontal strap around and over the bridge of the wearer's foot. Horizontal strap 24 may alternatively be formed from any natural or synthetic materials such as rubber, leather, nylon, or any other material known within the art. Furthermore, horizontal strap 24 may optionally include various adjusters for adjusting the length of the horizontal strap 24, so that it provides a tighter fit around the bridge and upper ankle portion of the wearer's foot, as desired. Adjusters may include buckles, cinches, loops or any other mechanical devices known within the art for tightening or controlling the length of the horizontal strap 24.

In the preferred embodiment, horizontal strap 24 is one solid band having a first terminal end 24*a* attached to the right sidewall section 20*e* of the sole 20, and a second terminal end 24*b* attached to the left sidewall section 20*f* of the sole 20. Alternatively, the first terminal end 24*a* may be attached to the right side 26*a* of the horizontal recess 26 and the second terminal end 24*b* may be attached to the left side 26*b* of the horizontal recess 26. The two terminal ends 24*a* and 24*b* of the horizontal strap 24 may be attached to the sole 20 or may be attached within the horizontal recess 26 using rivets, screws, latch members, adhesives, glue, or any other structure known within the art.

Second Embodiment

Figure 6:
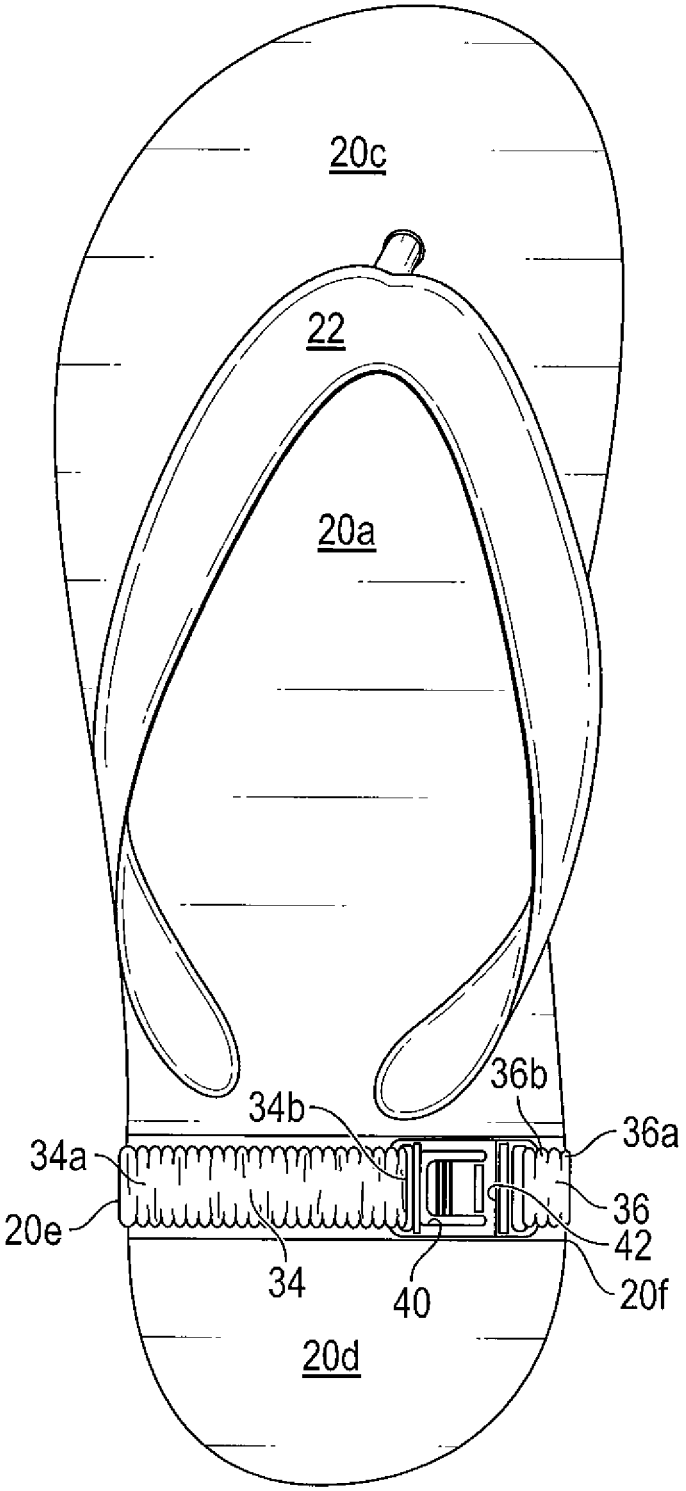
FIG. 6 is a second embodiment of a top view of the footwear functioning as a flip-flop with the horizontal strap attached to the side of the sole and having a releasable buckle in its stored flat position embedded in the horizontal recess or pocket of the heel section of the sole.
Figure 7:
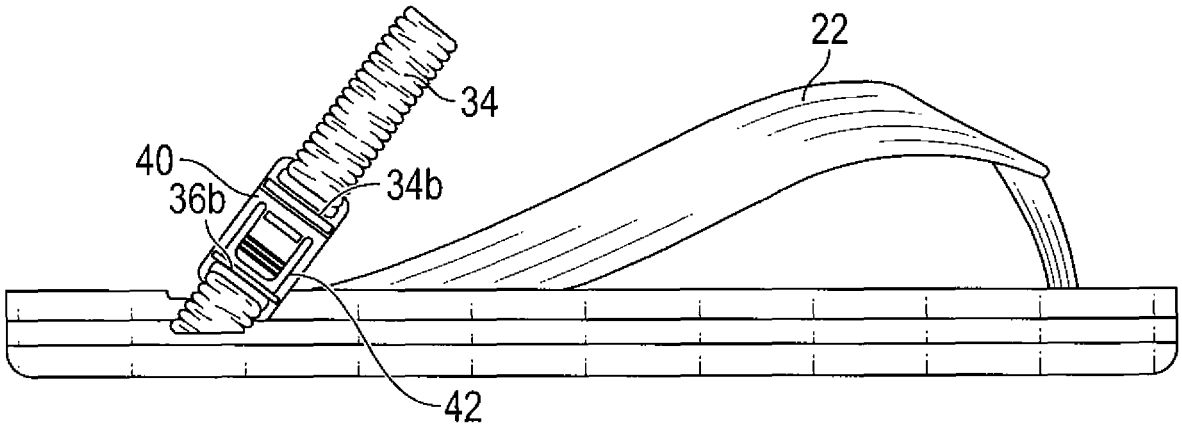
FIG. 7 is a second embodiment of the footwear functioning as a sandal with the horizontal strap attached to the side of the sole and having a releasable buckle in its raised position for encircling and covering the bridge of the wearer's foot to provide additional security for the wearer's foot.

In a second embodiment as shown in FIGS. 6 and 7, the horizontal strap 24 includes two horizontal bands, a first horizontal band 34 and a second horizontal band 36 that are mateably engageable with mechanical fasteners. These mechanical fasteners may include a hook-loop fastener, buckle, button, clip, snap, fastener, magnet, latch or any other means that are known within the art.

The first horizontal band 34 includes a first terminal end 34*a* and a second terminal end 34*b*. The first terminal end 34*a* of the first horizontal band 34 is attached to the right sidewall section 20*e* of the sole 20. The second terminal end 34*b* of the first horizontal band 34 is attached to a first mechanical fastener 40.

Similarly, the second horizontal band 36 includes a first terminal end 36*a* and a second terminal end 36*b*. The first terminal end 36*a* of the second horizontal band 36 is attached to the left sidewall section 20*f* of the sole 20. The second terminal end 36*b* of the second horizontal band 36 is attached to a second mechanical fastener 42.

The first mechanical fastener 40 of the second terminal end 34*b* of the first horizontal band 34 is mateably engageable with the second mechanical fastener 42 of the second terminal end 36*b* of the second horizontal band 36. As a result, the first horizontal band 34 and the second horizontal band 36 can be removably connected.

Third Embodiment

Figure 8:
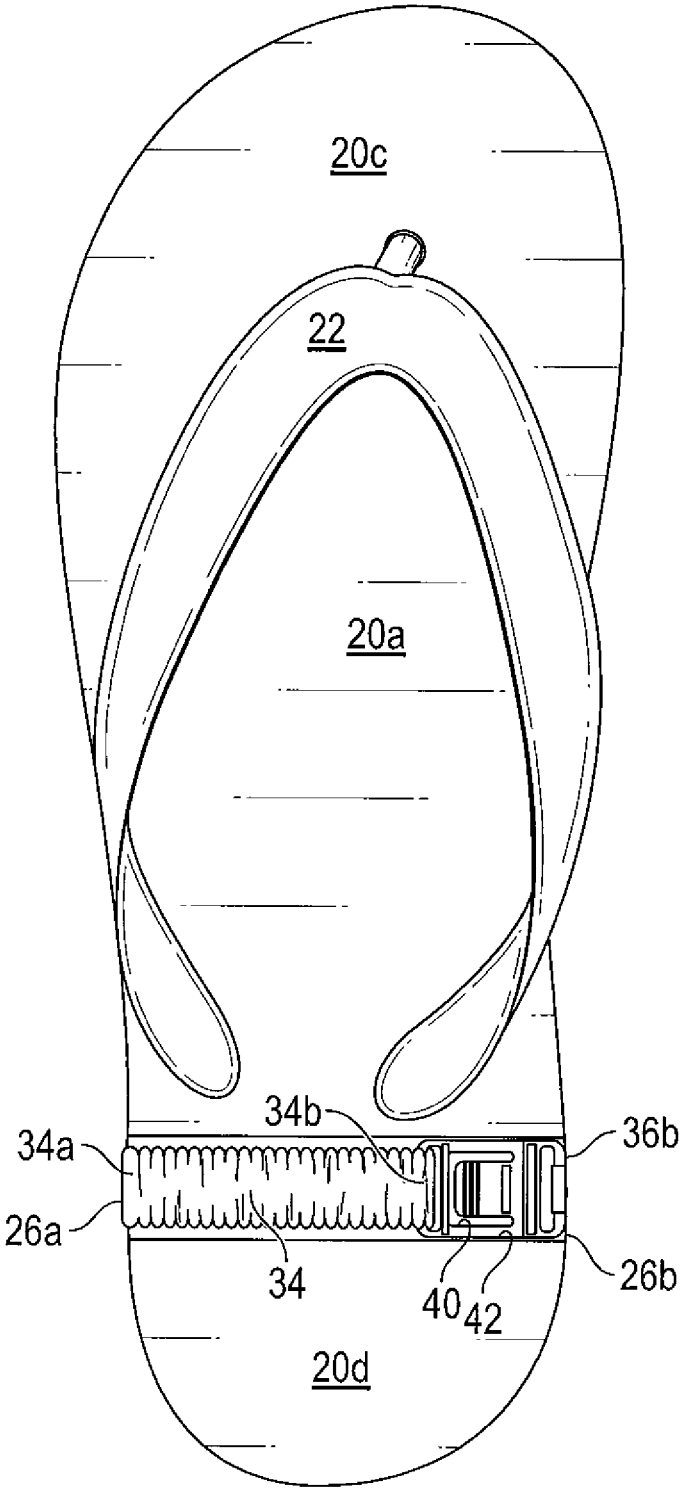
FIG. 8 is a third embodiment of a top view of the footwear functioning as a flip-flop with the horizontal strap attached within the horizontal recess or pocket having a releasable buckle in its stored flat position embedded in the horizontal recess or pocket of the heel section of the sole.
Figure 9:
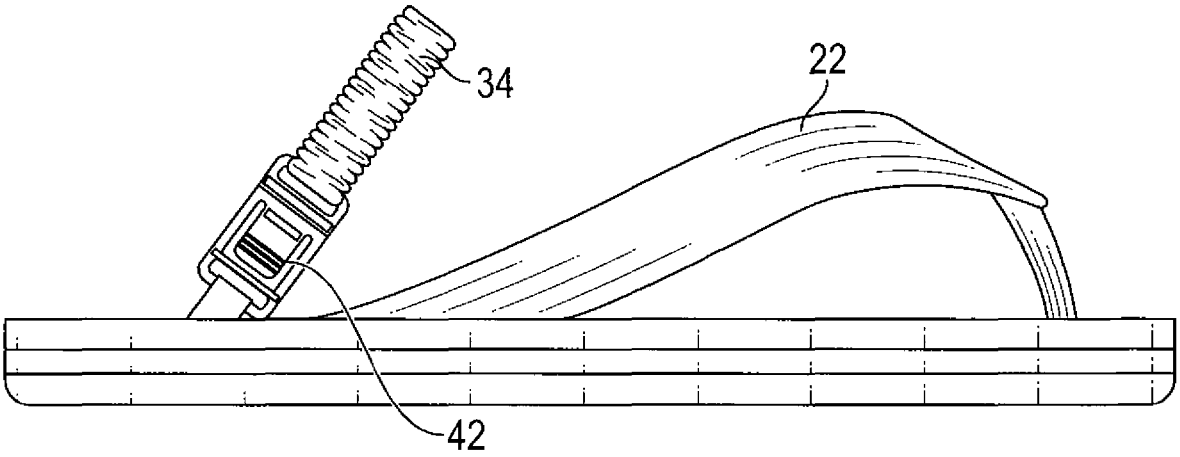
FIG. 9 is a third embodiment of the footwear functioning as a sandal with the horizontal strap attached within the horizontal recess or pocket having a releasable buckle in its raised position for encircling and covering the bridge of the wearer's foot to provide additional security for the wearer's foot.

In a third embodiment as shown in FIGS. 8 and 9, horizontal strap 24 includes two horizontal bands, a first horizontal band 34 and a second horizontal band 36 that are mateably engageable with mechanical fasteners. These mechanical fasteners may include a hook-loop fastener, buckle, button, clip, snap, fastener, magnet, latch or any other means that are known within the art.

The first horizontal band 34 includes a first terminal end 34*a* and a second terminal end 34*b*. The first terminal end 34*a* of the first horizontal band 34 is attached to the right side 26*a* of the horizontal recess 26. The second terminal end 34*b* of the first horizontal band 34 is attached to a first mechanical fastener 40.

Similarly, the second horizontal band 36 includes a first terminal end 36*a* and a second terminal end 36*b*. The first terminal end 36*a* of the second horizontal band 36 is attached to the left side 26*b* of the horizontal recess 26. The second terminal end 36*b* of the second horizontal band 36 is attached to a second mechanical fastener 42.

The first mechanical fastener 40 of the second terminal end 34*b* of the first horizontal band 34 is mateably engageable with the second mechanical fastener 42 of the second terminal end 36*b* of the second horizontal band 36. As a result, the first horizontal band 34 and the second horizontal band 36 can be removably connected.

While various embodiments of footwear 10 that is capable of changing between a flip-flop and a sandal have been described, it should be understood that they have been presented by way of example, and not limitation. For example, the shape, materials of construction, and design of the sole, forefoot cover, and horizontal strap as illustrated and described were not intended to be limiting.

OPERATION

The present invention provides footwear 10 capable of changing between a flip-flop and a sandal. When functioning as a flip-flop, the horizontal strap 24 is in the closed position and is removably embedded within the horizontal recess 26. In this position, the wearer's feet are secured to the flip-flop by their toes being secured to the toe thong construction of the forefoot cover 22.

In order to convert the footwear from a flip-flop to a sandal, the wearer pulls up the horizontal strap 24 from its embedded position within the horizontal recess 26 and then fastens and adjusts the horizontal strap 24 around the bridge and upper ankle portion of the wearer's foot, depending on the wearer's preferences. In this position, the wearer's feet are secured to the sandal by their toes being secured by the toe thong construction of the forefoot cover 22, and also secured to the sandal by the bridge and upper ankle portion of their feet being secured by the horizontal strap 24.

ADVANTAGES OF THE PRESENT INVENTION

It is an advantage of the present invention to provide a new and improved flip-flop that can optionally and easily be converted into a sandal by the user moving a horizontal strap that is stored and embedded within a recess formed in the sole of the flip flop when it is not in use.

Another advantage of the present invention is to provide a flip-flop with a movable horizontal strap that provides greater support and security to the bridge, heel, or ankle of the user's foot.

Another advantage of the present invention is to provide a new and improved flip-flop that can be converted into a sandal which may be easily and efficiently manufactured and marketed.

Another advantage of the present invention to provide a new and improved flip-flop that can be converted into a sandal which has a durable and reliable construction.

Another advantage of the present invention is to provide a new and improved flip-flop that can be converted into a sandal for providing multiple footwear styles for a wearer.

A further advantage of the present invention is to provide a new and improved flip-flop that can be converted into a sandal that has a low cost of manufacture with regard to materials and labor, and has a low cost to the consumer.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Footwear capable of changing between a flip-flop and a sandal comprising:

a sole including a top section, a forefoot section, a heel section, and a sidewall section; and forefoot V-shaped straps positioned and extending over at least a part of the forefoot section, and being secured to the top section of said sole;

a horizontal recess formed in the heel section of said top section of said sole for receiving a horizontal strap;

said horizontal strap being removably placed in said horizontal recess of the top section of said sole, wherein said horizontal strap is capable of moving between a first stored position within said horizontal recess and a second in-use raised position above the horizontal recess of the top section of the sole.

2. The footwear of claim 1, wherein said horizontal strap includes elastic material for adjusting said horizontal strap.

3. The footwear of claim 1, wherein said horizontal strap includes two terminal ends, and at least one of said terminal ends is removably attached by a buckle, a snap, or a hook and loop fastener to the sole.

4. The footwear of claim 1, wherein said horizontal strap includes two terminal ends, and at least one of said terminal ends is removably attached by a buckle, a snap, or a hook and loop fastener within said horizontal recess formed in the heel section of said sole.

5. The footwear of claim 1, wherein said horizontal strap includes two terminal ends, and at least one of the terminal ends is placed within said horizontal recess formed in the heel section of said sole.

6. The footwear of claim 1, wherein said horizontal strap includes two terminal ends and at least one of the terminal ends is attached to said sidewall section of the sole.

7. Footwear capable of changing between a flip-flop and a sandal comprising:

a sole including a top section, a forefoot section, and a heel section; and forefoot straps extending over at least a part of the forefoot section, and being secured to the top section of the sole;

a horizontal recess formed in the heel section of the top section of the sole for receiving a horizontal strap;

the horizontal strap being removably placed in the horizontal recess of the top section of the sole, wherein the horizontal strap is capable of moving between a first stored position within the horizontal recess and a second in-use raised position above the top section of the sole.

8. The footwear of claim 7, wherein the horizontal strap includes elastic material for adjusting the horizontal strap.

9. The footwear of claim 7, wherein the horizontal strap includes two terminal ends, and at least one of the terminal ends is removably attached by a buckle, a snap, or a hook and loop fastener to the sole.

10. The footwear of claim 7, wherein the horizontal strap includes two terminal ends, and at least one of the terminal ends is removably attached by a buckle, a snap, or a hook and loop fastener within the horizontal recess.

11. The footwear of claim 7, wherein the horizontal strap includes two terminal ends, and at least one of the terminal ends is placed within the horizontal recess formed in the sole.

12. The footwear of claim 7, wherein the horizontal strap includes two terminal ends and at least one of the terminal ends is attached to a sidewall section of the sole.

13. The footwear of claim 7, wherein the forefoot straps are V-shaped or Y-shaped.

14. Footwear capable of changing between a flip-flop and a sandal comprising:

a sole including a top section and forefoot section; and a forefoot strap positioned and extending over at least a part of the forefoot section, and being secured to the top section of the sole;

a horizontal recess formed in the top section of the sole for receiving a horizontal strap;

the horizontal strap being removably placed in the horizontal recess of the top section of the sole, wherein the horizontal strap is capable of moving between a first stored position within the horizontal recess and a second in-use raised position above the sole.

15. The footwear of claim 14, wherein the horizontal strap includes elastic material for adjusting the horizontal strap.

16. The footwear of claim 14, wherein the horizontal strap includes two terminal ends, and at least one of the terminal ends is removably attached by a buckle, a snap, or a hook and loop fastener to the sole.

17. The footwear of claim 14, wherein the horizontal strap includes two terminal ends, and at least one of the terminal ends is removably attached by a buckle, a snap, or a hook and loop fastener within the horizontal recess.

18. The footwear of claim 14, wherein the horizontal strap includes two terminal ends, and at least one of the terminal ends is placed within the horizontal recess.

19. The footwear of claim 14, wherein the horizontal strap includes two terminal ends and at least one of the terminal ends is attached to a sidewall section of the sole.

* * * * *